US005181642A

United States Patent [19]

Gentile et al.

[11] Patent Number: 5,181,642

[45] Date of Patent: Jan. 26, 1993

[54] PRESS FEED APPARATUS INCLUDING A LINKAGE MECHANISM HAVING A THREE-LINK ASSEMBLY FOR USE IN ROTATING STOCK MATERIAL FEED ROLLS

[75] Inventors: Joseph P. Gentile, Pittsburgh; Vaughn H. Martin, Aspinwall, both of Pa.

[73] Assignee: Vamco Machine & Tool, Inc., Pittsburgh, Pa.

[21] Appl. No.: 695,499

[22] Filed: May 3, 1991

[51] Int. Cl.[5] ..... B65H 20/18

[52] U.S. Cl. ..... 226/137; 226/139; 226/158

[58] Field of Search ..... 226/137, 138, 139, 147, 226/154, 158, 160, 162, 165, 166

[56] References Cited

U.S. PATENT DOCUMENTS

| | | | |
|---|---|---|---|
| 4,106,324 | 8/1978 | Gotz | 226/147 X |
| 4,316,569 | 2/1982 | Gentile | 226/139 X |
| 4,415,108 | 11/1983 | Katoh | 226/154 X |
| 4,420,107 | 12/1983 | Seyffert et al. | 226/138 X |
| 4,449,658 | 5/1984 | Gentile | 226/138 |
| 4,487,352 | 12/1984 | Paris | 226/154 |
| 4,599,683 | 10/1985 | Kato | 226/154 X |
| 4,601,420 | 7/1986 | Kato | 226/154 |
| 4,776,505 | 10/1988 | Kato | 226/154 X |
| 4,848,636 | 7/1989 | Kato | 226/154 X |

FOREIGN PATENT DOCUMENTS 53-43284 4/1978 Japan .

*Primary Examiner*—Daniel P. Stodola
*Assistant Examiner*—Paul Bowen
*Attorney, Agent, or Firm*—Reed Smith Shaw & McClay

[57] ABSTRACT

A press feed is provided having a simple, low-friction, low-inertia linkage mechanism to positively drive feed rolls or grippers of the press feed with substantially uniform pressure. The linkage mechanism includes a three-link assembly having first and second substantially parallel links and a third cross link pivotally connected to the first and second links. The first and second links are pivotally mounted to a housing of the press feed substantially equidistant from the connections to the third cross link. The third cross link has a groove extending substantially at right angles to the transverse axis of the third cross link extending between the connections of the third cross link to the first and second links. First and second slides are positioned in the groove in the third cross link and each slide is connected to a swing arm drivingly connected to the feed roll shafts such that upon operation of the press feed the third cross link moves through an arc defined by a preselected feed length to be fed by the press feed to the press.

8 Claims, 9 Drawing Sheets

PRESS FEED APPARATUS INCLUDING A LINKAGE MECHANISM HAVING A THREE-LINK ASSEMBLY FOR USE IN ROTATING STOCK MATERIAL FEED ROLLS

FIELD OF THE INVENTION

The present invention relates generally to press feeds for feeding stock material to a press and more particularly to press feeds for generating intermittent feeding of the stock material by rotational movement of one or more feed rolls.

BACKGROUND OF THE INVENTION

It is the conventional practice in high speed automatic press operations to feed a strip of stock material from a coil to a die of a press for stamping or the like at a preselected length of the stock material. The stock material must be fed from the coil in timed relation with the press operation by a press feed having feed rolls or grippers. Once in the press, the stock material is moved into registration with the die by pilots as the feed means are momentarily released from engagement with the stock material. The stock material is then held in position in the die for the press operation. After the press operation is completed the feed means are actuated to advance another preselected length of the stock material to the press. Therefore, the feeding of the stock material to the press must be coordinated with each press operation so that during each press cycle a new preselected length of stock material is in position in the die of the press.

U.S. Pat. Nos. 4,133,216 and 4,138,913 disclose one type of press feed where the feed length is changed by changing gears in the drive train between a cam drive and the feed rolls. Such a geared cam press feed is driven in synchronization with a press through an input shaft, typical from the crankshaft of the press, and converts the rotation of the input shaft to a noncontinuous stepwise, intermittent rotational movement of an output shaft that drives the feel rolls through a drive train. The feed rolls advance intermittently in segments through a rotational cycle preferably with dwell periods between the advances. During dwell periods, the feed rolls are not rotated and the stamping operation is performed in the die in the press. The feed rolls clamp the stock material at all times except during positioning of pilots during the press cycle.

U.S. Pat. Nos. 3,758,011 and 3,784,075 describe another type of press feed where the feed length is changed by a pivoted lever mechanism positioned in the drive train between a cardan drive and the feed rolls. The cardan drive is driven through an input shaft in synchronization with a press, and converts the continuous rotation of the input shaft into oscillating movement of a lever. One end of the lever is driven by the oscillating movement by the cardan drive and the other end of the lever is coupled to and drives the feed rolls. The feed length can be changed by moving the pivot of the lever along the length of the lever during each press cycle, when the feed rolls are released and returned, and a separate brake mechanism stops the stock material during roll return. See also, Japanese Patent Application Serial No. 53-43284, where a cam drive is used instead of the cardan drive, the pivot of the lever is fixed, and the connection of coupling from the end of the lever to the feed rolls is moved along the lever to change feed length. Piloting is typically accomplished by a feed roll release driven by a cam driven by the input shaft to the cardan drive. Adjustment of the piloting position in the press cycle is accomplished normally by rotationally positioning the cam relative to the input shaft.

U.S. Pat. No. 4,316,569 discloses another type of press feed where the feed length is changed by an adjustable cam drive. The cam drive is driven through an input shaft in synchronization with a press, and converts the continuous rotation movement of the input shaft into an intermittent, oscillating movement of an output shaft. An output shaft is fixed to one end portion of the output shaft of the cam drive, and a link mechanism is connected between the output shaft and the feed rolls. To change the feed length, the distance is changed between the output shaft from the cam drive and the connection of the link mechanism to the output shaft, preferably by connecting the link mechanism to a slide moved along the output shaft with a threaded adjusting means. The feed rolls clamp the stock material during forward advance of the feed length in the press and die, and a roll release releases the feed roll during the return in each press cycle and a clamp mechanism clamps the stock material during roll return. Both the roll release and the clamp mechanism are usually driven by separate cams driven by the input shaft to the cam drive. Piloting is accomplished by a adjustment between the cams actuating the roll release and material clamp, or by providing a third cam also driven by the input shaft that momentarily releases the material clamp. Adjustment of the piloting position in the press cycle is again accomplished manually by rotationally positioning the third cam relative to the input shaft.

One of the problems in all types of press feed such as those described above is positively driving both feed rolls efficiently and effectively with substantially uniform pressure. One press feed with such dual driven feed rolls is described in U.S. Pat. No. 4,601,420. One end of the link mechanism adjacent to the feed rolls is attached to an elongated orthogonal slider block which is slideably received in a horizontally extending guide groove provided in a guide channel secured to the feed housing. The slider block has a second block (or blocks) having vertically extending guide groove extending at right angles to the horizontally extending guide grooves. A first swing member is mounted in at one end to a first feed roll shaft and is drivingly connected at its other end to a slide positioned in the vertically extending guide groove, and a second swing member mounted at one end to a second feed roll shaft and drivingly connected at its other end to a slide positioned in the groove in the vertically extending groove. As the link mechanism oscillates, the orthoganal slider block also oscillates along the horizontally extending groove. Concurrently, the slides in the vertically extending grooves oscillate because of the oscillating motion of slider block to effect oscillating movement of the feed rolls.

The press feed of U.S. Pat. No. 4,601,420 experiences problems because the orthogonal slider block must be constrained to travel only in a path along the horizontal guide groove, and also the substantial area of surface contact between the orthogonal slider block the horizontal groove. The horizontal groove and the slider block must be machined to close fitting tolerances to achieve high speed press feeding. Friction and heat between the orthogonal slider block and the horizontally extending guide groove can cause degradation of lubricants, and to maintenance and replacement of worn parts and resulting costly downtime of the press feed and press. If, on the other hand, clearance between the slider block and the horizontal groove is provided to reduce friction, misalignment and related feed inaccuracies increase. Moreover, the orthagonal slider block has inertia that must be overcome at high speed operation (e.g., 1500-2000 spm) of the press feed and press, and presents a limiting factor to high speed operation.

A need exists, therefore, for a press feed positively driving both feed rolls in synchronization simply and efficiently, with substantially uniform press to the stock material by both feed rolls.

SUMMARY OF THE INVENTION

The present invention provides a press feed for intermittently feeding stock material and is comprised of an input shaft supported for rotation at a continuous preselected speed. The cam drive means are preferably drivingly connected to an output shaft with a output shaft fixed thereto for generating oscillating rotational movement of the output shaft and transfer arm. Feed means, e.g., feed roll or grippers, intermittently feeds a preselected length of the stock material in a selected moveable direction. A linkage mechanism is connected to a slide moveable along the output shaft and at another end to the feed means. The linkage mechanism is preferably operable to transmit the oscillating rotational movement of the output shaft and transfer arm to the feed means and oscillate the feed means through a preselected, variable angle of rotation. The feed means is activated by the oscillating rotational movement of the linkage mechanism to intermittently advance a preselected length of stock material corresponding to the angle of rotation of the feed means.

The linkage mechanism includes a transfer link member pivotably secured between the output shaft and to a three-link assembly. The first and second links of the three link assembly are substantially parallel to one another, preferably of the same length, and pivotally mounted preferably adjacent their first end portions to a press feed housing. The connections of first and second links to third cross link are unidistant from the pivot connections of the first and second links to the feed housing. The first and second links are pivotably connected, preferably at second end portions, to a third cross link member extending transversely to the first and second links.

The third cross link member has a groove extending substantially at right angles to the transverse axis extending between the connections to the first and second links. A first swing arm is drivingly connected to a first feed roll shaft and is drivingly connected to a first slide slideably positioned in a portion of the groove in the third cross link member. A second swing arm is drivingly connected to a second feed roll shaft and is drivingly connected to a second slide slideably positioned in a portion of the groove in the third cross link member, adjacent the first slide. In operation, as the transfer link oscillates, the first and second links swing causing the third cross link to swing through are defined arc corresponding to the preselected length of material fed by the press feed to the press. Simultaneously, the slides positioned in the groove in the third cross link oscillate by the movement of the third link member, causing equally applied positive, oscillatory drive of the feed means. Due to the short oscillatory movement of the slides in the groove in the cross link, heat caused by friction between the slides and groove is minimized. By this assembly, more importantly, the press feed is provided with a low inertia drive assembly that is capable of positively driving both feed means e.g., feed rolls or grippers, and in turn the feed stock, with substantially equal pressure.

Other details and advantages of the present invention will become apparent as the following description of the presently preferred embodiments and presently preferred methods of practicing the invention proceeds.

DESCRIPTION OF THE DRAWINGS

The invention will become more readily apparent from the following description of preferred embodiments thereof shown, by way of example only, in the accompanying drawings, where.

DETAILED DESCRIPTION OF THE INVENTION

Figure 1:
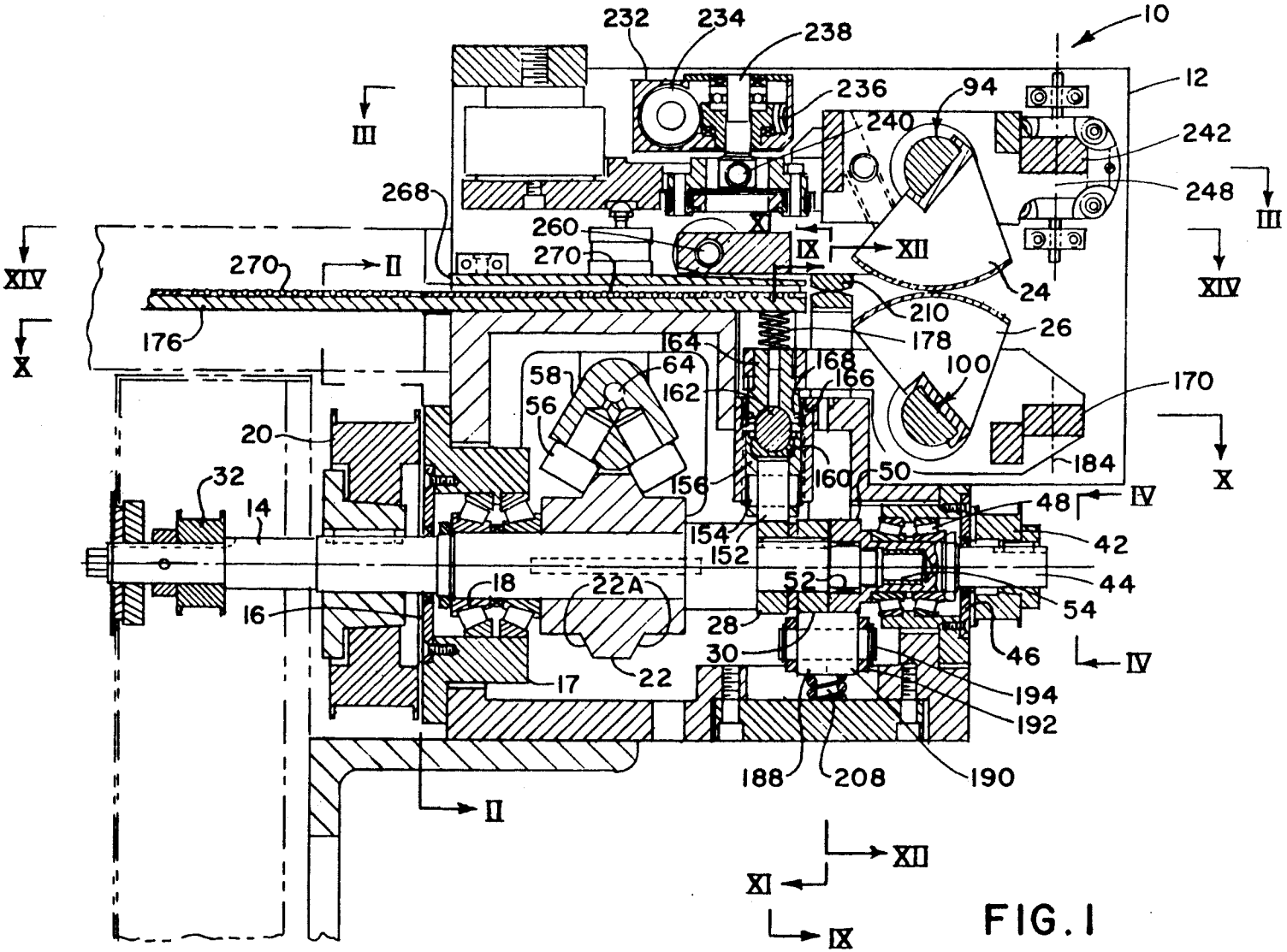
FIG. 1 is a side elevation view, in partial section, of a preferred embodiment of press feed for intermittently feeding stock material in accordance with the present invention.
Figure 2:
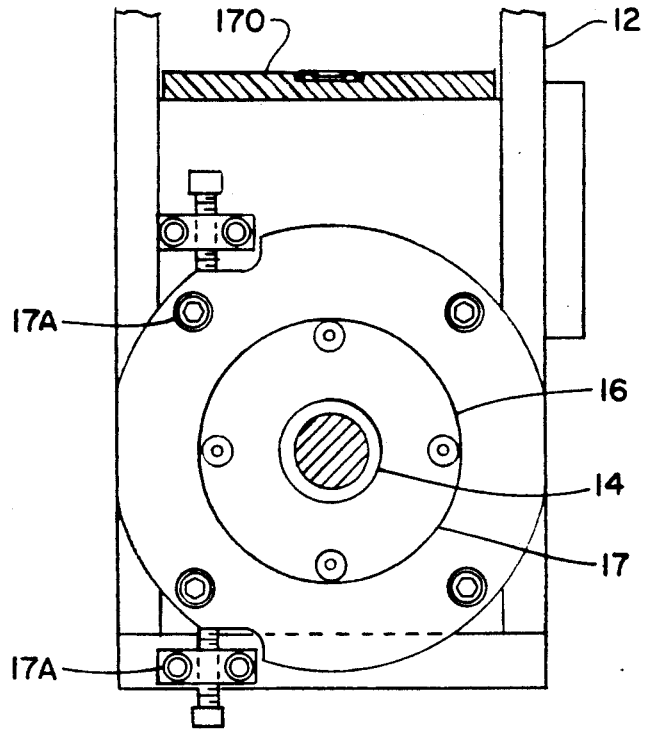
FIG. 2 is a view taken along line II—II of FIG. 1.

Referring to the drawings and particularly to FIGS. 1 and 2, there is illustrated a preferred embodiment of press feed apparatus of the present invention, generally designated by the numeral 10, for feeding continuous stock material from a reel to a power operated press, as for example a press for stamping, punching, cutting, or the like, of a preselected length of the stock material. The apparatus 10 includes a suitable housing 12 and an input shaft 14. The input shaft 14 extends through a first seal plate 16, which is shown in detail in FIG. 2, and extends substantially parallel to the material feed direction. An input shaft cartridge 17 carries the seal plate 16. The position of cartridge 17 may be adjusted relative to housing 12 by threaded adjustment elements 17A whereby the cam drive 22 can be preloaded. The input shaft 14 is supported for rotation in housing 12 by bearing assembly 18 and the seal carried by seal plate 16. Drivingly secured to input shaft 14 and driven by a timing belt from the press crankshaft is a timing pulley 20. Rotation of the crankshaft is transmitted by the timing pulley 20 to the input shaft 14 to rotate the input shaft 14 at a continuous preselected speed in synchronization with the press.

Drivingly secured to an intermediate region of the drive shaft 14 is an cam drive 22 which, as will be described in greater detail hereinafter, cooperates with other structure to convert the continuous rotation of the input shaft 14 to synchronous, intermittent oscillating rotation of upper and lower feed rolls 24 and 26, respectively. Positioned on one end of the input shaft 14 is a roll release cam 28 and adjacent thereto a clamp release cam 30 whose functions will be later described.

Figure 3:
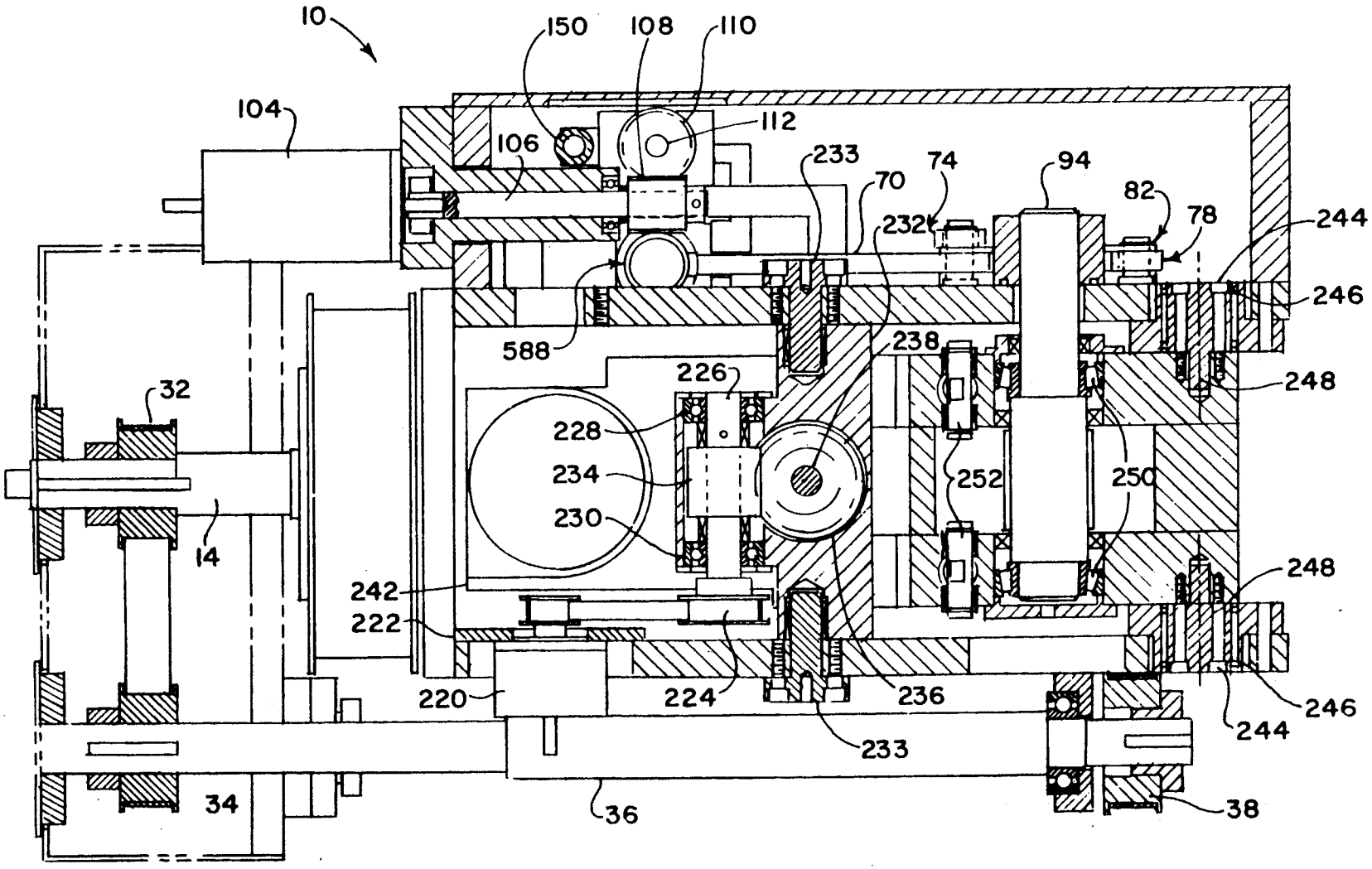
FIG. 3 is a view taken along line III—III of FIG. 1.

As shown in FIG. 3, also affixed to the input shaft 14 is another pulley 32 which, through an unillustrated belt, drives a pulley 34 that is drivingly mounted on a transfer drive shaft 36 that is rotatably supported by the housing and which extends substantially parallel to the input shaft 14. Thus, as the input shaft 14 is continuously driven by the press crankshaft, the transfer drive shaft 36 is continuously driven in synchronization with by the input shaft 14.

Drivingly connected at the other end of the transfer drive shaft 36 opposite the pulley 34 is an additional pulley 38 which is drivingly connected through a belt 40 (FIG. 4) to a cooperating pulley 42 that is drivingly positioned at an end of a second drive shaft 44 (FIG. 1) preferably positioned axially of the first input shaft 14 and parallel to transfer drive shaft 36. The second drive shaft 44 passes through a second seal plate 46 and is rotatably supported in housing 12 by a bearing assembly 48. The end of the second drive shaft 44 opposite pulley 42 has drivingly positioned thereon a pilot clamp release cam 50, the function of which will be described hereinafter. As is by now appreciated, continuous rotation of the press crankshaft causes continuous rotation of the input shaft 14, the transfer drive shaft 36 and the second drive shaft 44. To maintain axial alignment of input shaft 14 and second drive shaft 44, a reduced diameter end portion of input shaft 14 is received in a socket formed in the second drive shaft while bearings 52 and 54 permit relative rotation between shafts 14 and 44 for times when it is desired to adjust the angular position of second drive shaft 44 relative to input shaft 14.

Figure 5:
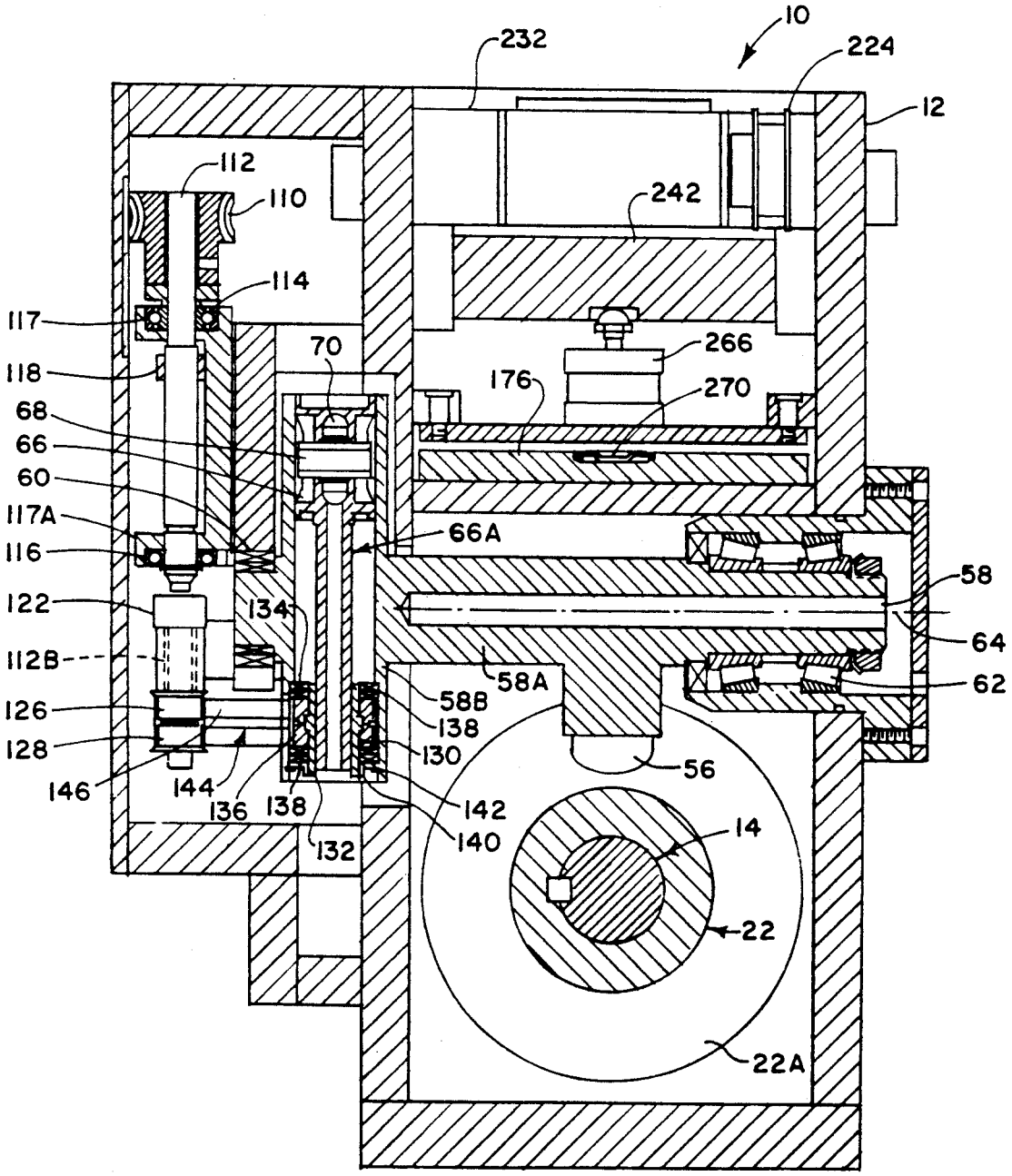
FIG. 5 is a cross section taken along a vertical plane passing through an output shaft member of the press feed of the present invention and extending transverse to the stock material feed direction.

Cam surfaces 22A of the aforementioned cam drive 22 are contacted by a pair of cam followers 56 which are carried by an output shaft 58. As shown in FIG. 5, output shaft 58 is rotatably supported at its opposite ends in housing 12 by bearing assemblies 60 and 62 so as to pivot about axis 64.

With this assembly, continuous rotation of input shaft 14 of cam drive 22 is converted by movement of the cam followers 56 along the cam surfaces 22A of the cam drive 22 to oscillating rotational movement of the output shaft 58 through a preselected angle of rotation determined by the path of the cam surfaces 22A of cam drive 22. As an example, as the cam followers 56 follow the cam surfaces 22A during the course of one revolution of the cam drive 22, the output shaft 58 first rotates from an initial position through a preselected angle, e.g., 60°. The output shaft then stops during a first dwell period of rotation of the cam drive 22 and then resumes rotation in the opposite direction through an angle of 60°. The output shaft 58 is then returned to its initial starting position and is stopped during a second dwell period of rotation of the cam drive 22. This is a modified sine curve-type cam feed which compensates for the inertia of the moving stock material by accelerating the stock material from an initial rest position to a maximum feed rate and then decelerating the stock material from the maximum feed rate to the rest position.

The oscillation of the output shaft 58 from an initial position through a preselected angle and then back through the same angle to the initial position occurs in one complete revolution of the cam drive 22. By continuously rotating input shaft 14 of the cam drive 22, the output shaft 58 is continuously oscillated back and forth through a preselected angle of rotation. At the end of each angle of rotation the output shaft 58 preferably experiences a dwell period in which it does not move. As will be later discussed, the oscillation of output shaft 58 drives a linkage mechanism to positively drive and oscillate the upper and lower feed rolls 24 and 26 through a desired angle of oscillation which may be varied to attain a desired incremental stock material feed length.

Figure 6:
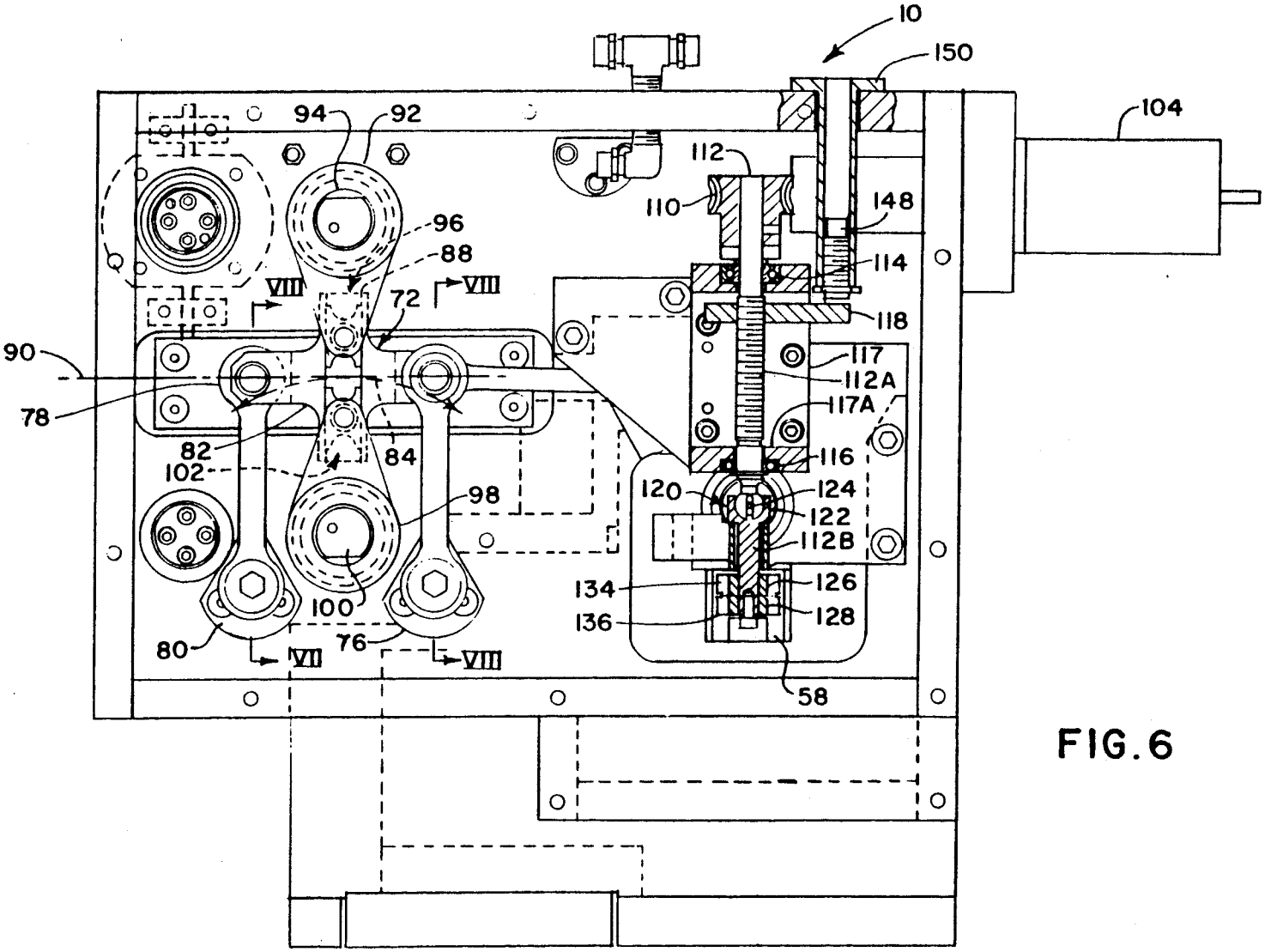
FIG. 6 is a side elevation view, in partial section, of an opposite side of the press feed shown in FIG. 1 with a housing cover omitted to clearly display the details of the feed roll oscillating mechanism.

As is most clearly shown in FIG. 5, output shaft 58 is preferably formed as a unitary member having a first cylindrical portion 58A, and has a transfer arm 58B fixed at one end portion extending generally transverse to the cylindrical portion 58A. The transfer arm 58B angularly oscillates preferably in a substantially vertical plane during oscillation of output shaft 58. Adjustably supported within the transfer arm 58B is a slide 66. The slide is provided with a bore which receives a pin 68 that pivotally attaches one end of a transfer link 70 of a link mechanism to the slide 66. The opposite end of the output shaft link 70, as represented most clearly in FIGS. 3 and 6, is pivotally attached to a three-link assembly of linkage mechanism 72. Specifically, the transfer link 70 is pivotally attached to one end portion, the "upper" end, of a first support link 74 of linkage mechanism 72. The opposite or "lower" end portion of the first support link 74 is pivotally attached to housing 12 and spaced therefrom by a link support 76. Spaced from and parallel to the first support link 74 is a second support link 78 which is preferably substantially the same in length to the first support link. The second support link 78 is also pivotally attached to housing 12 and is spaced therefrom by link support 80. For proper operation of the linkage mechanism 72, the elevations of the pivotal attachment points of the first and second links 74 and 78 to the housing 12 need to be such that a third cross link 82 and groove 88 therein (described below) provide for like rotational, oscillating movement of the feed rolls.

The upper ends of the first and second support links 74 and 78 are pivotally connected to opposite ends of the third cross link member 82 extending transversely to the first and second support links. Like the pivotal attachment points of the first and second support links 74 and 78 to the housing 12, the elevations of the pivotal attachment points of support links 74 and 78 to the third link 82 are the same distance from the pivotal attachments to the housing. As a consequence, the attitude of the third link member 82 remains the same as the linkage mechanism 72 is oscillated through a preselected arc, herein denoted by dot-dash line 84, by the oscillating motion of the transfer link 70. Furthermore, by virtue of its pivotal connection to first and second support links 74 and 78, the third cross link 82 is free to translate both horizontally and vertically during oscillation of the linkage mechanism 72 by transfer link 70. Hence, a substantial portion of the inertia, friction and wear resulting from slider member to only horizontal motion as taught, for example, in U.S. Pat. No. 4,601,420, is eliminated, while providing a press feed with less parts and simpler to construct.

Figure 7:
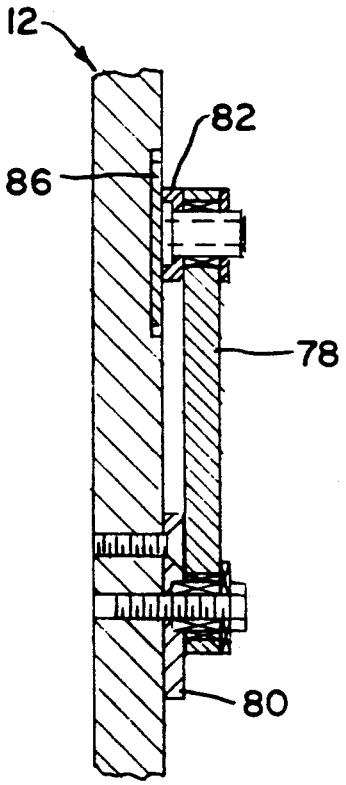
FIG. 7 is a view taken along line VII—VII of FIG. 6.
Figure 8:
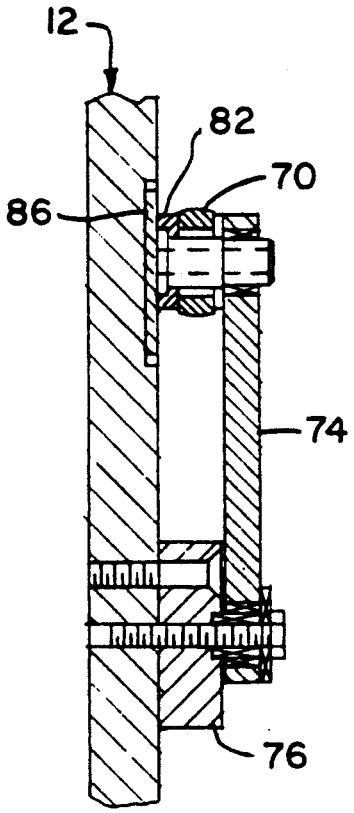
FIG. 8 is a view taken along line VIII—VIII of FIG. 6.

The housing 12 is fitted with a plate 86 which is lightly contacted by an inner surface of the third cross link member 82 and which serves to laterally assist the first or second link supports 76 and 80 in maintaining stability of the linkage mechanism 72. Since plate 86 does not in any way constrain the oscillating motion of the third cross link 82, friction between the plate 86 and the third cross link 82 is virtually nonexistent. In order to further minimize friction in the material feeding operation of the apparatus 10, all pivotal connections of the transfer link 70 and the three link mechanism 72 of linked members are provided with low-friction bearings. Additional details of the interconnections between the housing 12 and the first, second and third links 74, 78 and 82 are provided in cross-sectional views of FIGS. 7 and 8.

A groove 88 is formed in the third cross link 82 extending at right angles to the transverse axis 90 of the third cross link 82 between the connections to first and second link 74 and 78. Because of the particular arrangement of the previously described pivotal connections of the first and second support links 74 and 78, the orientation of groove 88 is maintained during oscillation of the linkage mechanism 72 so that the feed rolls move through the same angular rotation with each oscillation. And, by virtue of its pivotal connections with the first and second support links 74 and 78 described hereabove, the third cross link 82 is free to translate in a direction parallel to and in a direction perpendicular to its longitudinal axis 90 during oscillation of linkage mechanism 72.

A swing arm 92 is drivingly mounted at one end thereof to the shaft 94 of the first feed roll 24. The other end of the swing arm 92 is pivotally attached by a frictionless bearing to a first slide 96 configured to position within groove 88 of third cross link 82. Similarly, a swing arm 98 is drivingly mounted at one end portion thereof to the shaft 100 of the second feed roll 26. The other end of the swing arm 98 is pivotally attached by a low-friction bearing to a second slide 102 which, like slide 96, is configured to position within groove 88. Therefore, as the transfer link 70 of linkage mechanism 72 oscillate, the slides 96 and 102 are translated along groove 88 because of the oscillating motion of the third cross link 82 while also moving toward and away from one another in groove 88. The concurrent and composite motions of slides 96 and 102 thus impart oppositely directed cranking motions to the swing arms 92 and 98, respectively, to thereby effect synchronous, contrarotating oscillating movement of the feed rolls 24 and 26.

FIGS. 3, 5 and 6 reveal a preferred mechanism of apparatus 10 for adjusting the stock material feed length. By employing the stock material feed length adjusting mechanism, adjustments in the feed length can be easily performed by changing the length of travel of the output shaft link 70 as described in detail in U.S. Pat. No. 4,316,569.

The stock material feed length adjustment mechanism includes a power source motor 104 (e.g., stepper motor, air motor, servo motor, or the like) attached to the housing 12 and having a drive shaft 106 extending therefrom into the housing 12. Power source 104 may be pneumatically, electrically or hydraulically operated, as desired. Positioned on drive shaft 106 is a worm gear 108 which engages with a worm gear 110 that is fixed to an upper end of a first section 112A of a two-section power transmission shaft 112. Opposite end regions of the first section 112A of the two-section power transmission shaft 112 are rotatably supported in bearings 114 and 116 carried in a channel member 117 attached to housing 12. An intermediate region of the first shaft section 112A is threaded and is threadedly engaged in a sensor activator plate 118, the function of which will be described hereinafter.

As shown in FIG. 6, formed on the lower end of the first section 112A of the two-section power transmission shaft 112 is a spherical ball member 120 that is received in an upper socket 122 formed in a second section 112B of shaft 112. A pin 124 secures the ball member 120 to the socket 122 at a location which is coincident with the output shaft pivot axis 64 to thereby create a universal coupling between the first section 112A and the second section 112B of power transmission shaft 112 which permits the second section 112B to oscillate with transfer arm 58B during operation of the feed apparatus 10.

At least one and, preferably, a pair of pulleys 126 and 128 are affixed to the lower end of second section 112B of power transmission shaft 112. Extending downwardly from the slide 66 is an externally threaded shaft portion 66A. Threaded onto threaded shaft portion 66A are upper and lower internally threaded bushings 130 and 132 about which pulleys 134 and 136, respectively, are carried by a tight friction fit. The internally threaded bushings 130 and 132 and their associated pulleys 134 and 136 are restrained from axial movement in the transfer arm 58B by upper and lower thrust washers and a lower retainer cap 140 and snap ring 142. Although restricted from axial movement, it will be understood that pulleys 134 and 136 are free to rotate within transfer arm 58B. Entrained about pulleys 126 and 134 is a belt 144 and similarly entrained about pulleys 128 and 136 is a belt 146. Belts 144 and 146 serve to transfer power from power transmission shaft 112 to rotate pulleys 134 and 136.

In order to adjust the length of travel of the transfer link 70, and thus the stock material incremental feed length, the power source motor 104 is activated to rotate drive shaft 106 and worm gear 108. Worm gear 108, in turn, rotates power transmission shaft 112 and the pulleys 126 and 128 affixed to the lower end thereof. The rotation of the pulleys 126 and 128 drives the belts 144 and 146 to cause rotation of pulleys 134 and 136. The rotation of pulleys 134 and 136 causes rotation of the internally threaded bushings 130 and 132 about the externally threaded shaft portion 66A depending from slide 66; and the rotation of bushings 130 and 132 about externally threaded shaft portion 66A drives the slide 66 either upwardly or downwardly within the transfer arm 58B depending upon the direction of rotation of the bushings 130 and 132. The shorter the distance between the axis of the link pin 68 (which pivotally joins the transfer link 70 to the slide 66) and the pivot axis 64 of transfer arm 58B, the shorter the length of travel of transfer link 70 and, consequently, the incremental feed length of the stock material.

As previously mentioned, threadedly engaged with the threaded intermediate region of the first shaft section 112A of the power transmission shaft 112 is a sensor activator plate 118. During rotation of power transmission shaft 112 the sensor activates plate travels either upwardly or downwardly along the threaded intermediate region of the first shaft section 112A. At the lowermost extent of its travel, plate 118 contacts an upwardly facing surface 117A of channel member 117 which indicates that output shaft pivot axis 64 and the axis of link pin 68 are substantially in alignment, i.e., the length of travel of transfer link 70 is at or substantially near zero. At the uppermost extent of its travel sensor activator plate 118 contacts the lower end of a proximity sensor 148 (FIG. 6) which is supported in a cartridge 150. Proximity sensor 148 is in communication with power source 104 such that when the sensor activator plate 118 comes into contact with the proximity sensor 148 the power source 104 is automatically shut off, thus indicating the maximum available length of travel of the transfer link 70 and the maximum available stock material feed length has been reached. The stock material feed length is, however, infinitely adjustable by power source 104 between zero and the maximum available feed length.

Figure 9:
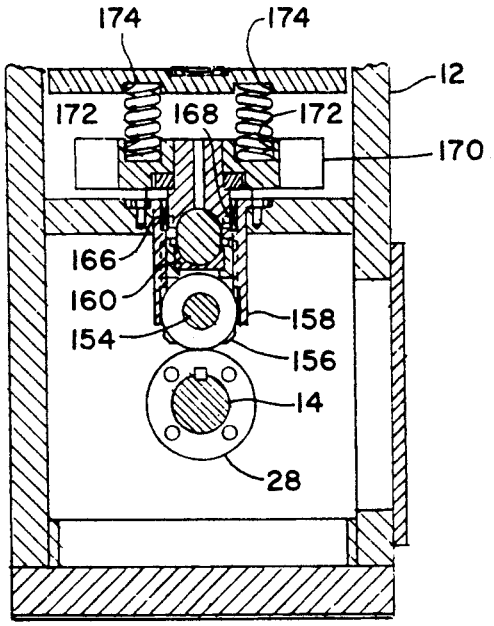
FIG. 9 is a view taken along line IX—IX of FIG. 1.

Turning once more to FIG. 1, and also to FIG. 9, it is seen that the roll release cam 28 is contacted by a roll release cam follower 152 which is rotatably supported by pin 154 in a roll release lifter 156. Roll release lifter 156 is received, preferably by a splined connection, in a stationary support member 158 that is indirectly secured to housing 12. Held within roll release lifter 156 is a lever arm pusher insert 160 that is provided with a concave surface configured to abuttingly and matingly receive a lower convex end of a lever arm pusher 162. The upper end of the lever arm pusher 162 is also convex and is abuttingly and matingly received in a lower concave surface of a lever arm pusher socket 164 that is flexibly retained in an upper portion of the stationary support member 158 by bushing 166 and O-ring 168. The uppermost end of the lever arm pusher socket 164 is, in turn, received in an opening provided at a first end of a lower lever arm 170. The upper surface of the lower lever arm 170 is provided with a pair of upwardly facing bores 172 located on opposite sides of the lever arm pusher•socket 164 (FIG. 9) which are positioned vis-a-vis with a pair of downwardly facing bores 174 formed in the lower surface of a lower material pass plate 176. Compressively retained in the pairs of opposed bores 172 and 174 is a pair of compression springs 178 for applying a downwardly directed biasing force to the first end of the lower lever arm 170. With this arrangement, the roll release cam follower 152 is maintained in constant contact with roll release cam 28 and, as will be appreciated from the following, the upper and lower feed rolls 24 and 26 are biased into a release or non-gripping position in relation to the stock material.

Figure 10:
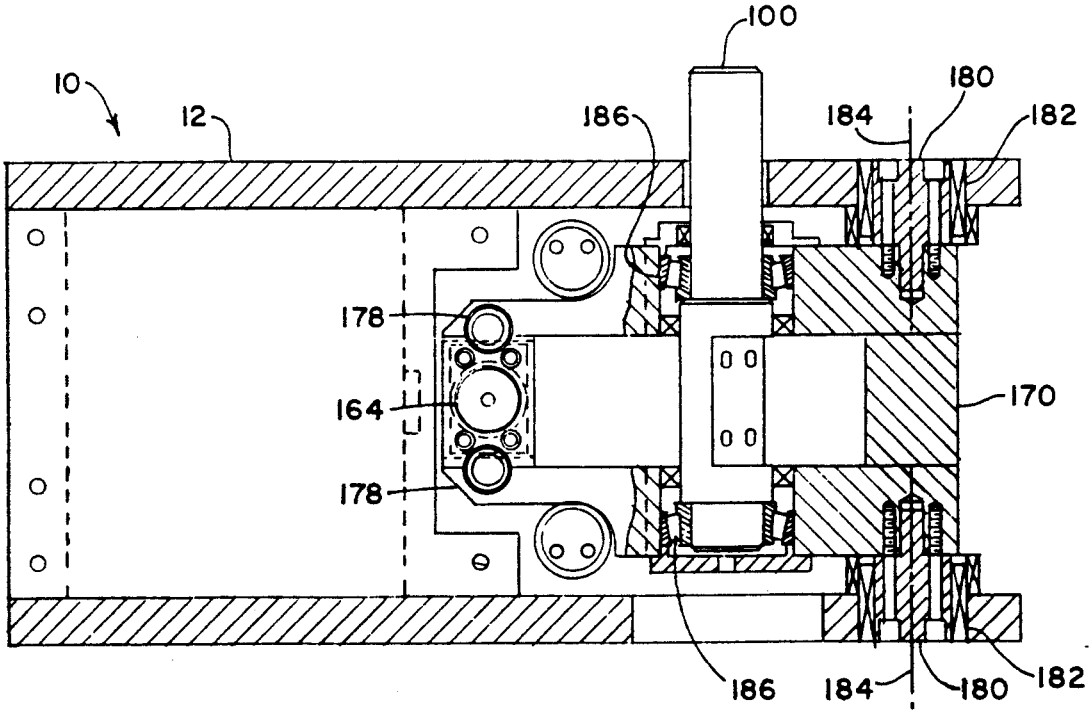
FIG. 10 is a view taken along line X—X of FIG. 1.

FIG. 10 reveals that the lower lever arm 170 is pivotally mounted at its second end to housing 12 by a pair of pivot stub shafts 180 which are rotatably supported in housing 12 by bearing assemblies 182. Lower lever arm is thus pivotable about spaced-apart but collinear axes 184 of stub shafts 180. FIG. 10 also shows that the lower feed roll shaft 100 is supported for rotation in lower lever arm 170 by spaced apart bearing assemblies 186.

In operation, the continuous rotation of input shaft 14 causes continuous rotation of the roll release cam 28. As aforementioned, lower lever arm 170 is biased downwardly by compression springs 178. However, as the "high" side of the roll release cam 28 approaches and then contacts the roll release cam follower 152, the serially abutting roll release lifter 156, lever arm pusher insert 160 and lever arm pusher socket 164 exert upwardly directed force on the first end of the lower lever arm 170 in opposition to and of greater magnitude than the downwardly directed biasing force of the compression springs 178. Such upwardly directed force thus causes the lower lever arm 170 to pivot upwardly about axes 184 to assume a position whereby the faces of feed rolls 24 and 26 grippingly contact opposite sides of the stock material. During this time in which the feed rolls are in gripping engagement with the material, the material is fed by the simultaneous and synchronous angular movement of the feed rolls. Once the material is fed a preselected incremental distance by the feed rolls, the "high" side of the roll release cam 28 has fully passed the roll release cam follower 152 and the "low" side of the roll release cam 28 approaches and then contacts follower 152, whereby the compression springs 178 are permitted to expand somewhat and the lower lever arm 170 is returned to a release position. In such position, the feed rolls 24 and 26 are released from driving engagement with the stock material.

Figure 11:
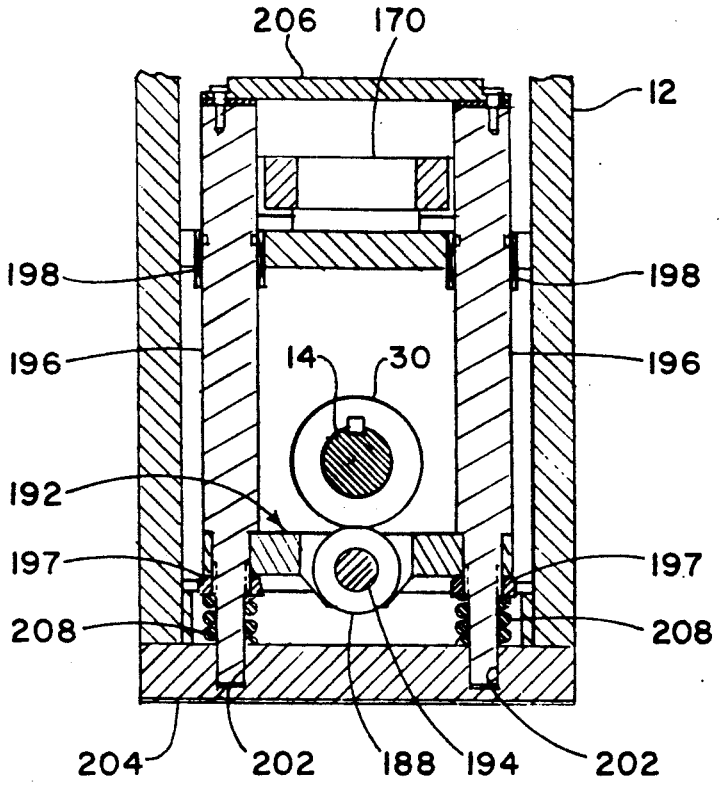
FIG. 11 is a view taken along line XI—XI of FIG. 1.

After completion of the angular feeding movement of the feed rolls 24 and 26, a first dwell period occurs during which time the feed rolls 24 and 26 are released from driving engagement from the material in the manner described above, and a clamping mechanism, which may be best appreciated by reference to FIGS. 1 and 11, is actuated to clamp and prevent movement of the material as the feed rolls 24 and 26 are counter-rotated back to their initial positions. When the feed rolls have been counter-rotated through a preselected angle of rotation, a second dwell period occurs during which time the clamping mechanism is released from engagement with the material and the feed rolls 24 and 26 are again moved back into driving engagement with the material for feeding another increment of the material to the press.

Referring to FIGS. 1 and 11, there is shown the details of a preferred embodiment of the stock material clamping mechanism of the press feed apparatus 10 of the present invention. As mentioned previously, along with the roll release cam 28, a clamp release cam 30 is also affixed to the input shaft 14. The clamp release cam 30 is contacted by a clamp release cam follower 188 that, along with a pilot release cam follower 190, is rotatably supported in a cam follower frame 192 by a pin 194. The cam follower frame 192 is fixedly retained at its opposite ends to spaced apart clamp posts 196 by lock nuts 197 (FIG. 11). The clamp posts 196 are guided for axial reciprocation in races 198 that are carried by an internal support plate 200 attached to housing 12 and also by bores 202 provided in the upper surface of a base plate 204 of the housing 12 which receives the lower ends of the clamp posts 196. A lower clamp bar 206 is attached to the upper ends of the clamp posts 196. The clamp posts 196, and thus the lower clamp bar 206, are biased upwardly into a clamping position in gripping contact with the stock material by a pair of compression springs 208, each of which surrounds a respective clamp post 196 adjacent the lower end thereof and is compressed between a lock nut 197 and the base plate 204.

In operation, the continuous rotation of input shaft 14 causes continuous rotation of the roll release cam 30. As stated hereabove, the lower clamp bar 206 is biased upwardly by compression springs 208. However, as the "high" side of the clamp release cam 30 approaches and then contacts the clamp release cam follower 188, the interconnected cam follower frame 192 and clamp posts 196 exert downwardly directed force through lock nuts 197 on the upper ends of the compression springs 208 in opposition to and of greater magnitude than the upwardly directed biasing force of the compression springs 208. Such downwardly directed force thus causes the lower clamp bar 206 and thereby its counterpart upper clamp bar 210 (FIG. 1) to be released from gripping engagement with the opposite sides of the stock material. During this time in which the material is released form clamp bars 206 and 210, the material is gripped by the feed rolls 24 and 16 and is fed by the simultaneous and synchronous angular movement of the feed rolls. After the material has been fed a preselected distance by the feed rolls, the "high" side of the clamp release cam 30 has fully passed the clamp release cam follower 190 and the "low" side of the clamp release cam 30 approaches and then contacts follower 190, whereby the compression springs 208 are permitted to expand somewhat and the lower clamp bar 206 is returned to a clamping position. In such position the clamp bars 206 and 210 are grippingly engaged with the material.

The clamp release cam 30 and the roll release cam 28 are also adjustably connected to rotate with the input shaft 14 that extends through the housing 12. By changing the respective angular positions of the clamp release cam 30 and roll release cam 28 on the input shaft 14 and then securing the cams in the selected position, it is possible to change the sequence of the clamp release and roll release operations to take place during the first dwell period or the second dwell period, respectively. By changing the sequence of the clamp release and the roll release operations it is possible to change the stock material feed direction to either push the stock material into or pull the material away from the press. As stated above, the cam drive 22 for controlling the feed of the material to the press is synchronized with the movement of the clamp release cam 30 and the roll release cam 28. Therefore, the operation of feeding the material can take place upon rotation of the output shaft 58B in either a clockwise direction or a counterclockwise direction. Accordingly, the direction of rotation of the transfer arm 58B to actuate feeding of the stock material to the press determines during which dwell periods the operations of clamp release and roll release take place.

Figure 12:
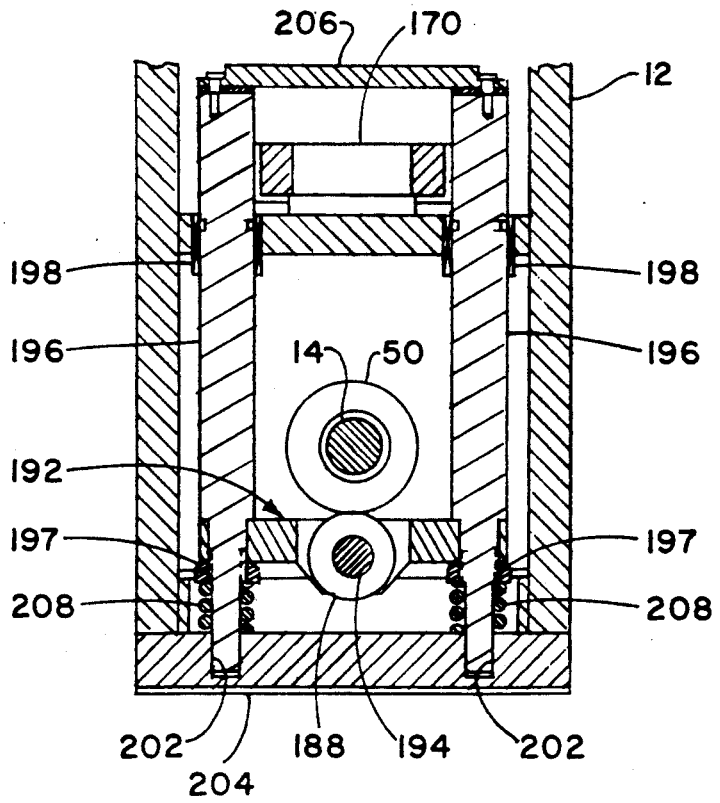
FIG. 12 is a view taken along line XII—XII of FIG. 1.

FIG. 12 depicts certain details of a preferred momentary clamp release mechanism that works in conjunction with the above-described material clamping mechanism. The momentary clamp release mechanism operates to momentarily release the material clamping mechanism to permit engagement of the material by the die pilots of the press which register the position of the material in the press prior to stamping of the material. The momentary clamp release mechanism also operates to overcome the biasing force of the compression springs 208 to release the clamp bars 206 and 210 from gripping engagement with the material. In particular, the momentary clamp release mechanism includes the aforementioned momentary clamp release cam 50 which is carried by the second drive shaft 44. As noted hereinabove, the second drive shaft 44 is caused to continuously rotate with input shaft 14. Moreover, the pilot clamp release cam operates to release the lower clamp bar 208 in the same manner as clamp release cam 30. That is, as the "high" side of the pilot clamp release cam 50 approaches and then contacts momentary release cam follower 190, the interconnected cam follower frame 192 and clamp posts 196 exert downwardly directed force through lock nuts 197 on the upper ends of the compression springs 208 in opposition to and of greater magnitude than the upwardly directed biasing force of the compression springs 208. Again, such downwardly directed force causes the lower clamp bar 206 and, therefore, the upper clamp bar 210 to be released from gripping engagement with the opposite sides of the material.

The pilot clamp release mechanism is timed to operate during a specified period of time within that portion of the revolution of input shaft 14 in which the clamp bars 206 and 210 grippingly engage the material, that is, when a "low" side of the clamp release cam 30 is in contact with its cam follower 188. In particular, the angular position of pilot release cam 50 relative to release cam 30 must be preselected such that it releases clamp bars 206 and 210 during a period of time in which feed rolls 24 and 26 are not in contact with the material. Otherwise, the press die pilots cannot properly function to register the stock material for stamping. Although not illustrated in detail, a suitable mechanism is provided for adjusting the position and, thus, the timing of pilot clamp release cam 50 relative to that of clamp release cam 30.

Figure 4:
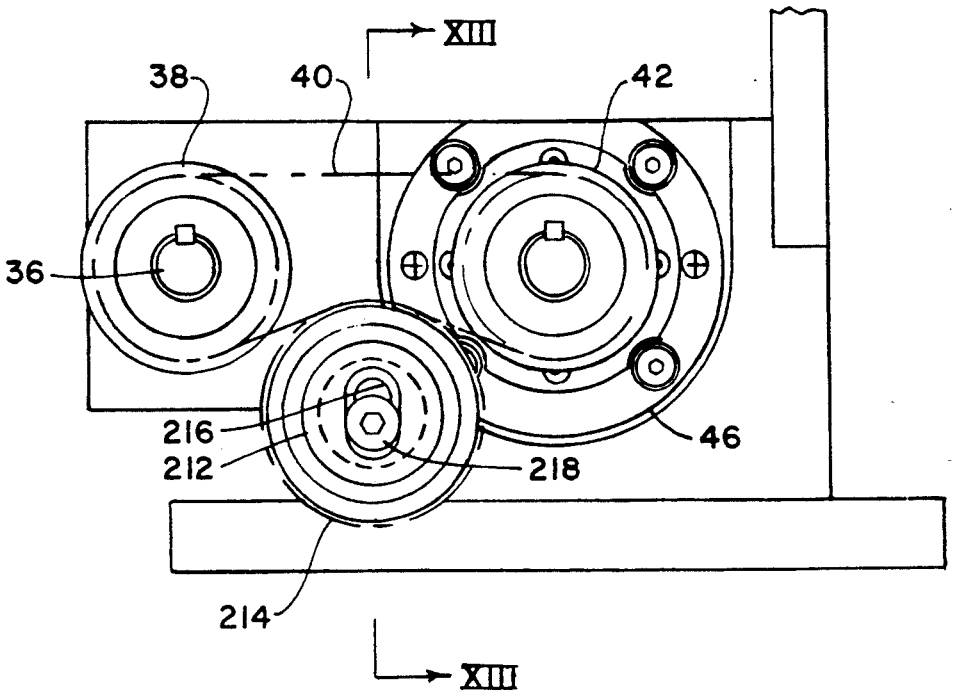
FIG. 4 is a view taken along line IV—IV of FIG. 1.
Figure 13:
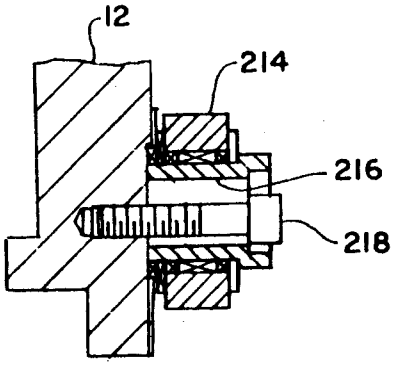
FIG. 13 is a view taken along line XIII—XIII of FIG. 4.

FIGS. 4 and 13 disclose a suitable mechanism for adjusting the tension in belt 40 to prevent slippage thereof. The belt adjustment mechanism is comprised of an adjustable release cartridge 212 which rotatably supports an idler pulley 214. Cartridge 212 is provided with a vertically-elongated through-bore 216 through which is passed a bolt fastener 218 that is threadably engageable with the housing 12. When it is desired to adjust the tension in belt 40, fastener 218 is loosened and cartridge 212 is slid to a position sufficient to achieve a desired tension in belt 40. Once the proper tension in belt 40 is achieved, the selected position is then retained by re-tightening fastener 218.

Figure 14:
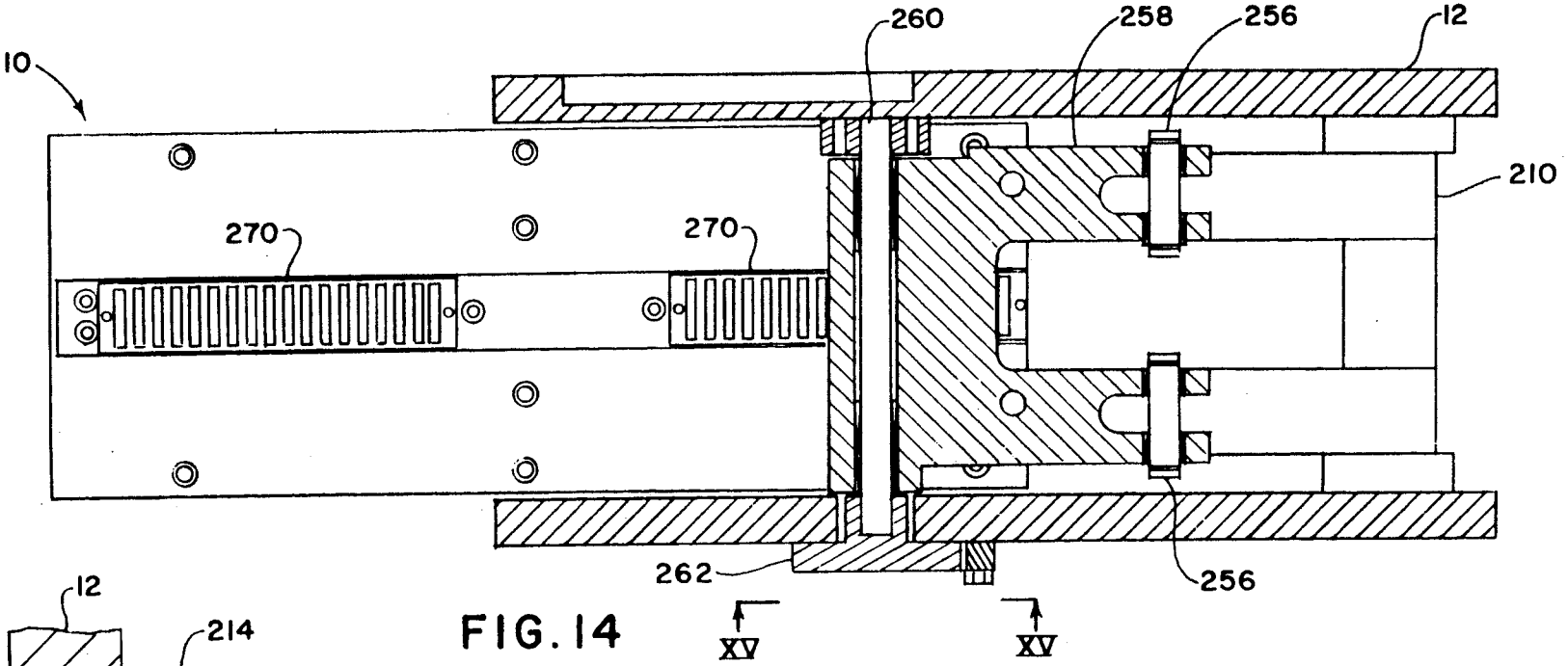
FIG. 14 is a view taken along line XIV—XIV of FIG. 1.
Figure 15:
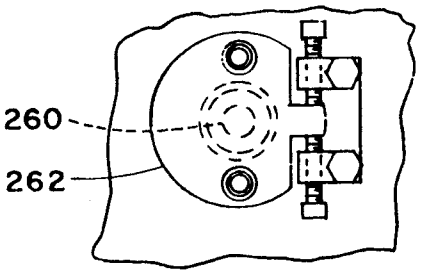
FIG. 15 is a view taken along line XV—XV of FIG. 14.

Looking once again to FIGS. 1 and 3, and also to FIGS. 14 and 15, there is illustrated a mechanism for adjusting the distance between the faces of the clamp bars 206 and 210 and the faces of the feed rolls 24 and 26 to accommodate a desired stock material thickness. The material thickness adjustment mechanism includes a second power source 220 (e.g., stepper motor, air motor or servo motor) (FIG. 3) which, like the first power source 104, is electrically, pneumatically or hydraulically operated. Furthermore, it is contemplated that manual adjustment mechanisms such as hand wheels may be substituted for first and/or second power sources 104 and 220 if desired.

Secured to an output shaft of the second power source 220 is a pulley 222 which is drivingly connected to a pulley 224 that is affixed to an end of a shaft 226. Shaft 226 is rotatably supported by bearing assemblies 228 and 230 in a bracket 232 which is pivotally secured to housing 12 by pivot shafts 233 (FIG. 3). Mounted to an intermediate region of shaft 226 is a worm gear 234 which engages with a worm gear 236. Worm gear is provided with an internally threaded bore into which is threaded an adjustment pin 238, the lower and of which carries a clevis pin 240. Clevis pin 240 extends horizontally through and engages an intermediate region of an upper lever arm 242.

Upper lever arm 242 is pivotally mounted at one end to housing 12 by a pair of pivot stub shafts 244 which are rotatably supported in housing 12 by bearing assemblies 246. Upper lever arm 242 is thus pivotable about spaced apart, collinear axes 248 of stub shafts 244. FIG. 3 also reveals that the first feed roll shaft 94 is supported for rotation in first swing arm 242 by spaced apart bearing assemblies 250. A pair of link pins 252 in first swing arm 242 are joined by links 254 (FIG. 1) to a corresponding pair of link pins 256 (FIG. 14) mounted in a material thickness lever arm 258, the bottom surface of which carries the upper clamp bar 210. The end of the material thickness lever arm opposite link pins 256 is pivotally mounted to housing 12 by pivot shaft 260. FIG. 15 illustrates a preferred adjustment cartridge mechanism 262 for maintaining a consistent degree of spacing between the faces of clamp bars 206 and 210.

Returning to FIG. 1, it is shown that an air bag 264, or an equivalent force producing member, is used to apply a steady downward force against the upper surface of the first swing arm 242 at the end of the first swing arm 242 opposite the pivot axes 248. When it is desired to adjust the spacing between the clamp bar faces and feed roll faces, pressurized air is released from air bag 264 and the power source motor 220 is activated to turn gears 234 and 236 in order to raise or lower adjustment pin 238 and, therefore, upper lever arm 242, roll 24, material thickness lever arm 258, and upper clamp bar 210.

An air cylinder 266, which is normally not employed during operation of the press feed apparatus 10, is mounted to an upper material pass plate 268 and is used to slightly lift the first swing arm 242 so that stock material can be manually inserted into apparatus 10 at start-up of a feeding and pressing operation. Also, the lower material pass plate is preferably provided with track roller assemblies 270 in order to reduce friction caused by passage of the stock material between upper and lower material pass plates 268 and 176.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. In a press feed having feed means shafts and means for driving the feed means shafts, the improvement comprising:

a linkage mechanism connecting the feed means shafts to the means for driving same, the linkage mechanism including a three-link assembly having first and second links substantially parallel and a third cross link pivotally connected to the first and second links, with the first and second links pivotally mounted to a housing of the press feed substantially equidistant from the connections to the third cross link; the third cross link having a groove extending substantially at right angles to the transverse axis of the third cross link extending between the connections to the first and second links; and first and second slides positioned in the groove in the third cross link and each connected to swing arms drivingly connected to the feed means shafts such that upon operation of the press feed the third cross link moves through an arc defined by a preselected feed length to be fed by the press feed to a press.

2. The press feed as claimed in claim 1 wherein the linkage mechanism further comprises a transfer link pivotally connected to the three-link assembly.

3. The press feed as claim in claim 1 wherein the first and second links are substantially equal in length.

4. The press feed as claimed in claim 3 wherein the first and second links are pivotally mounted at end portions to the housing of the press feed and pivotally mounted at opposite end portions to the third cross link.

5. A press feed comprising:

(a) a cam drive means driven by continuous rotation of an input shaft capable of being driven in synchronization with a press, the cam drive means converting the rotation of the input shaft to intermittent rotation of an output shaft;

(b) feed means capable of intermittently feeding stock material to a press in preselected lengths;

(c) a drive means drivingly connecting the output shaft of the cam drive means to the feed means and driving the feed means for advancing intermittently material stock to a press in preselected lengths;

(d) said drive means including a three-link assembly having first and second links substantially parallel and a third cross link pivotally connected to the first and second links, with the first and second links being pivotally mounted to a housing of the pres feed substantially unidistant from the connections to the third cross link;

(e) the third cross link having a groove extending substantially at right angles to the transverse axis of the third cross link extending between the connections to the first and second links; and (f) first and second slides positioned in the groove in the third cross link each connected to swing arms drivingly connected to feed roll shafts such that upon operation of the press feed the third cross link moves through an arc defined by a preselected feed length to be fed by the press feed to a press.

6. The press fed as claimed in claim 5 further comprises a transfer link pivotally connected to the third three-link assembly.

7. The press feed as claimed in claim 5 wherein the first and second links are substantially equal in length.

8. The press feed as claimed in claim 7 wherein the first and second links are pivotally mounted at end portions to the housing of the press feed and pivotally mounted at opposite end portions to the third cross link.

* * * * *